US011035374B2

(12) United States Patent
Swaby

(10) Patent No.: US 11,035,374 B2
(45) Date of Patent: Jun. 15, 2021

(54) SHAFT SEAL INCLUDING AN UPSTREAM NON-CONTACT PART

(71) Applicant: SULZER MANAGEMENT AG, Winterthur (CH)

(72) Inventor: Alan Swaby, County Wexford (IE)

(73) Assignee: SULZER MANAGEMENT AG, Winterthur (CH)

( * ) Notice: Subject to any disclaimer, the term of this patent is extended or adjusted under 35 U.S.C. 154(b) by 141 days.

(21) Appl. No.: 16/343,116

(22) PCT Filed: Nov. 20, 2017

(86) PCT No.: PCT/EP2017/079791
§ 371 (c)(1),
(2) Date: Apr. 18, 2019

(87) PCT Pub. No.: WO2018/095867
PCT Pub. Date: May 31, 2018

(65) Prior Publication Data

US 2019/0257317 A1 Aug. 22, 2019

(30) Foreign Application Priority Data

Nov. 22, 2016 (EP) ..... 16199938

(51) Int. Cl.
*F04D 29/10* (2006.01)
*F01D 25/18* (2006.01)
(Continued)

(52) U.S. Cl.
CPC ..... *F04D 29/102* (2013.01); *F01D 11/02* (2013.01); *F01D 25/183* (2013.01);
(Continued)

(58) Field of Classification Search
CPC ..... F04D 29/08; F04D 29/10; F04D 29/102; F01D 25/183; F16J 15/34; F16J 15/3404;
(Continued)

(56) References Cited

U.S. PATENT DOCUMENTS 3,167,969 A 2/1965 Dilworth et al.
5,158,304 A * 10/1992 Orlowski ..... B21B 31/078 277/421
(Continued)

FOREIGN PATENT DOCUMENTS

EP 1417429 A1 5/2004
WO 2008/042698 A1 4/2008
WO 2010/051959 A1 5/2010

OTHER PUBLICATIONS

International Search Report and Written Opinion dated Feb. 19, 2018 in corresponding International Application No. PCT/EP2017/079791, filed Nov. 20, 2017.

*Primary Examiner* — Woody A Lee, Jr.
*Assistant Examiner* — Maxime M Adjagbe
(74) *Attorney, Agent, or Firm* — Global IP Counselors, LLP

(57) ABSTRACT

A rotary machine includes a stationary housing, a rotor, a shaft, a bearing unit, and a sealing arrangement to seal the bearing unit with respect to the rotor. The sealing arrangement includes a stationary sealing element surrounding the shaft. The sealing arrangement includes a rotor ring to prevent an axial flow along the shaft to the rotor and a cover plate, the rotor ring rotationally fixedly connected to the rotor and arranged axially adjacent to the sealing element, the rotor ring including a radially outer edge extending in the axial direction and surrounding the sealing element. The cover plate is fixed with respect to the housing and surrounding the rotor ring, and has an outer rim, a drain
(Continued)

chamber formed between the outer edge of the rotor ring and the outer rim of the cover plate, and a discharge passage to discharge the drain chamber.

20 Claims, 4 Drawing Sheets

(51) Int. Cl.
*F04D 29/063* (2006.01)
*F01D 11/02* (2006.01)

(52) U.S. Cl.
CPC ..... *F04D 29/063* (2013.01); *F05B 2240/50* (2013.01); *F05B 2240/57* (2013.01); *F05D 2240/70* (2013.01); *F05D 2260/6022* (2013.01)

(58) Field of Classification Search
CPC ..... F16J 15/3416; F16J 15/40; F16J 15/443; F16J 15/447
See application file for complete search history.

(56) References Cited

U.S. PATENT DOCUMENTS 5,300,261 A * 4/1994 Von Berg ..... B01F 3/04539 261/87
6,343,794 B1 2/2002 Brown
8,348,595 B2 * 1/2013 Koch ..... F02C 6/12 415/111

* cited by examiner

SHAFT SEAL INCLUDING AN UPSTREAM NON-CONTACT PART

CROSS-REFERENCE TO RELATED APPLICATION

This application is a U.S. National Stage application of International Application No. PCT/EP2017/079791, filed Nov. 20, 2017, which claims priority to European Patent Application No. 16199938.8, filed Nov. 22, 2016, the contents of each of which are hereby incorporated herein by reference.

BACKGROUND

Field of the Invention

The invention relates to a rotary machine for acting on a fluid.

Background of the Invention

A conventional rotary machine for acting on a fluid, for example a pump, a compressor, a blower, an expander or a turbine, typically comprises a stationary housing enclosing a rotor for interacting with the fluid and a shaft for rotating the rotor about an axial direction. The shaft can be driven by a drive unit. The rotary machine further comprises at least one bearing unit with a radial and/or an axial (thrust) bearing for supporting the shaft and the rotor. Typically, the bearing has a separate casing which is fixedly connected to the housing of the rotary machine. Since the bearings usually require lubrication and/or cooling a lubricant, for example an oil or any other suited fluid, is supplied to the bearing unit. In many applications this lubricant should neither leak from the bearing unit into the environment nor contact the fluid the rotary machine is acting on to avoid any contamination of this fluid or the environment with the lubricant. In addition, the lubricant flowing into the rotor or contacting the rotor should be avoided. The lubricant escaping from the bearing unit and contacting the rotor may cause considerable damage and even machine failures.

Therefore, it is common state of the art to provide a sealing arrangement for sealing the bearing unit with respect to the rotor and the environment, such that the lubricant cannot escape from the bearing unit. The sealing arrangement typically encloses the shaft of the rotor at a location where the shaft of the rotor exits the bearing unit.

SUMMARY

Basically, there are two different types of sealing arrangements for sealing a rotating shaft, namely those with contact seals and those with contactless seals. Contact seals comprise sealing elements that physically contact the rotating shaft during rotation. Such an arrangement is for example a gland or a stuffing boxes or a lip-seal. A drawback of contact seals is that the physical contact between the stationary seal and the rotating shaft results in energy consumption and thus reduces the rotary machine's efficiency. In addition, especially in case of large diameters of the shaft or high rotational speeds of the shaft, there is the risk that contact seals cannot withstand the surface velocities or are worn away after a very short operating time.

Sealing arrangements with contactless or noncontact sealing elements do not have any direct physical contact with the rotating shaft during normal operation. A well-known design for a contactless sealing element is the labyrinth seal design. Due to the nonexistent contact with the rotating shaft these contactless sealing elements cause at least considerably lower friction losses and remarkably less wear and tear. However, it is an intrinsic property of a contactless sealing element that there is always at least small leakage flow through the sealing element along the shaft. Due to the running clearance between the rotating shaft and the sealing element it is not possible to completely seal around the rotating shaft. Lubricant tracking along the shaft and across the sealing element results in the risk that the lubricant escapes in the environment or leaks to the rotor where it causes damage or contamination.

During operation of the rotary machine this leakage along the shaft of the rotor may even be enhanced by pressure differentials generated by the rotor, for example by the impeller of the rotor in a pump or in a compressor. Such pressure differentials may suck the lubricant from the bearing unit to the rotor.

Starting from this state of the art it is therefore an object of the invention to propose a rotary machine with an improved sealing arrangement that prevents or at least considerably reduces a leakage flow through the sealing arrangement along the shaft, such that, for example, a lubricant cannot escape from the bearing unit and contact the rotor. In addition, the sealing arrangement shall have the advantages of the contactless design.

The subject matter of the invention satisfying these objects is characterized by the features disclosed herein.

Thus, according to the invention a rotary machine for acting on a fluid is proposed comprising a stationary housing, a rotor for interacting with the fluid, a shaft for rotating the rotor about an axial direction, a bearing unit for supporting the rotor, and a sealing arrangement for sealing the bearing unit with respect to the rotor, wherein the rotor is arranged in the housing, and wherein the sealing arrangement comprises a stationary sealing element surrounding the shaft and designed for a contactless sealing of the shaft, and wherein the sealing arrangement further comprises a rotor ring for preventing an axial flow along the shaft to the rotor, and a cover plate, wherein the rotor ring is rotationally fixedly connected to the rotor and arranged axially adjacent to the sealing element, wherein the cover plate is fixed with respect to the housing and surrounds the rotor ring, wherein a drain chamber is formed between the rotor ring and the cover plate, and wherein a discharge passage is provided for discharging the drain chamber.

In particular, a rotary machine for acting on a fluid is proposed comprising a stationary housing, a rotor for interacting with the fluid, a shaft for rotating the rotor about an axial direction, a bearing unit for supporting the rotor, and a sealing arrangement for sealing the bearing unit with respect to the rotor, wherein the rotor is arranged in the housing, and wherein the sealing arrangement comprises a stationary sealing element surrounding the shaft and designed for a contactless sealing of the shaft, and wherein the sealing arrangement further comprises a rotor ring for preventing an axial flow along the shaft to the rotor, and a cover plate, wherein the rotor ring is rotationally fixedly connected to the rotor and arranged axially adjacent to the sealing element, wherein the rotor ring comprises a radially outer edge extending in the axial direction and surrounding the sealing element, wherein the cover plate is fixed with respect to the housing and surrounds the rotor ring, wherein the cover plate has an outer rim extending in the axial direction, wherein a drain chamber is formed between the outer edge of the rotor ring and the outer rim of the cover plate, and wherein a discharge passage is provided for discharging the drain chamber.

The rotor ring, which is arranged adjacent to the sealing element and torque-proof connected with the rotor for co-rotating with the rotor prevents an axial flow along the shaft to the rotor. Any fluid, for example a lubricant that leaks from the sealing element along the shaft cannot proceed in axial direction to the rotor due to the rotor ring. Thereby, any tracking along the shaft surfaces is stopped by the rotor ring. Due to the rotation of the rotor ring during operation the lubricant reaching the rotor ring is transferred by centrifugal forces away from the shaft area in a radially outward direction. The stationary cover plate that covers the rotor prevents the lubricant which is forced outwards by the rotor ring from contacting or reaching the rotor at a location away from the shaft. The lubricant is collected in a drain chamber between the rotor ring and the cover plate. The drain chamber is in fluid communication with a discharge passage so that the lubricant is led off from the drain chamber in a controlled manner. Thus, the sealing arrangement prevents both a leakage flow towards the rotor and a leakage to the environment without surrendering the advantages of a contactless sealing. The rotor ring enclosing the shaft typically has an inner diameter which is at most as large as the inner diameter of the sealing element. Preferably, the inner diameter of the rotor ring is somewhat smaller than the inner diameter of the contactless sealing element, so that the rotor ring is in direct physical contact with the shaft.

The outer rim of the cover plate is advantageous in particular to ensure that the lubricant cannot escape from the drain chamber to the environment. The outer edge of the rotor ring is advantageous to collect the lubricant that is moved radially outwards by the centrifugal forces generated by the rotating shaft or rotor ring, respectively.

In order to improve the sealing action of the rotor ring with respect to the axial direction it is preferred that the rotor ring has a radially inner edge provided with a circumferential groove for receiving an annular seal, preferably an O-ring seal, that encloses the shaft.

According to a preferred embodiment, the rotor ring is separated from the sealing element regarding the axial direction by a first gap that is configured as a running fit. Thus, with respect to the axial direction the rotor ring is arranged as close as possible to the sealing element without jeopardizing the contactless rotation of the rotor ring with respect to the sealing element. The width of the first gap, i.e. its extension in the axial direction, is for example less than 1 mm or approximately 0.5 mm. This close running fit considerably reduces the impact of the pressure difference between the rotor or the housing, respectively, and the bearing unit during operation. The suction of lubricant from the bearing unit towards the rotor is at least remarkably attenuated.

It is an advantageous measure when the cover plate is designed as a ring-shaped cover plate having an inner edge region that overlaps the rotor ring with respect to the radial direction. The overlap between the rotor ring and the cover plate eliminates or at least considerably reduces the risk that any lubricant can escape between the rotor ring and the cover plate.

Preferably the inner edge region of the cover plate is separated from the rotor ring by a second gap that is configured as a running fit. The very small extension of the second gap in axial direction is advantageous from the view of preventing the lubricant from leaking between the rotor ring and the cover plate. In addition, the very narrow second gap also contributes to the reduction of the impact of the pressure difference in an analogous manner as it has been explained with respect to the first gap.

In a preferred embodiment the radially outer edge of the rotor ring tapers towards the rotor. By this measure it is ensured that any lubricant collecting on the radially outer surface of the rotor ring is moving or flowing in a direction away from the rotor.

In this respect, it is a further preferred measure that a radially outer surface of the outer edge of the rotor ring is configured to include an inclination angle with the radial direction, the inclination angle being smaller than 90°, preferably at most 85°.

According to a preferred embodiment the cover plate and the rotor ring are arranged in an annular recess disposed in the bearing unit. Usually the bearing unit comprises a separate casing that is fixedly connected to the housing containing the rotor, for example by screws or bolts. The casing of the bearing unit can then include a recess for receiving the sealing arrangement. The diameter of the recess in radial direction is only somewhat larger than the outer diameter of the cover plate of the sealing arrangement to enable a close fit of the sealing arrangement in the recess.

In order to realize a reliable sealing between the recess and the cover plate arranged in the recess it is preferred, that the cover plate comprises a ring-shaped sealing member, preferably an O-ring sealing, for sealing between the recess and the cover plate, the sealing member being arranged in a circumferential groove in the outer rim of the cover plate. Thus, the lubricant cannot escape to the environment by leaking between the wall delimiting the recess and the cover ring.

Especially in view of a simple design it is preferred that the discharge passage is designed as a bore in the bearing unit.

Praxis has shown that it is particularly suited, when the discharge passage has an inner diameter of at most 20 mm, preferably of at most 10 mm.

According to a further preferred measure the discharge passage is connected to a drain channel of the bearing unit. This is a very simple and efficient way to recycle the lubricant to the backflow of the bearing unit.

Preferably, the sealing element of the sealing arrangement is designed as a labyrinth seal.

In a preferred embodiment the rotary machine is a blower, a compressor, a pump, an expander or a turbine.

In view of an important possible application the rotary machine may be designed as a blower or a compressor in an aeration system for providing a fluid, in particular water, with air.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
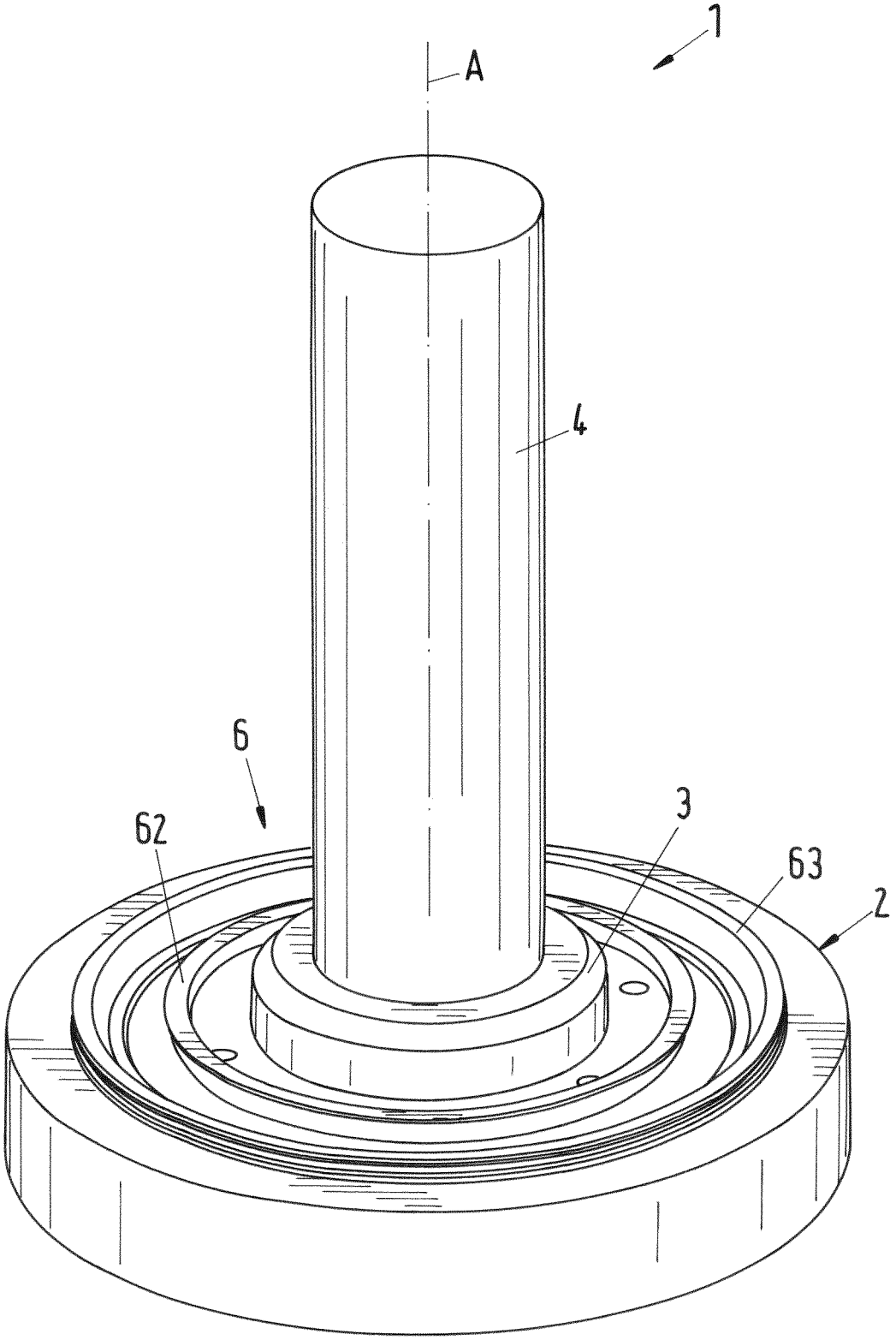
FIG. 1 is an illustration of an embodiment of a rotary machine in a perspective view.
Figure 2:
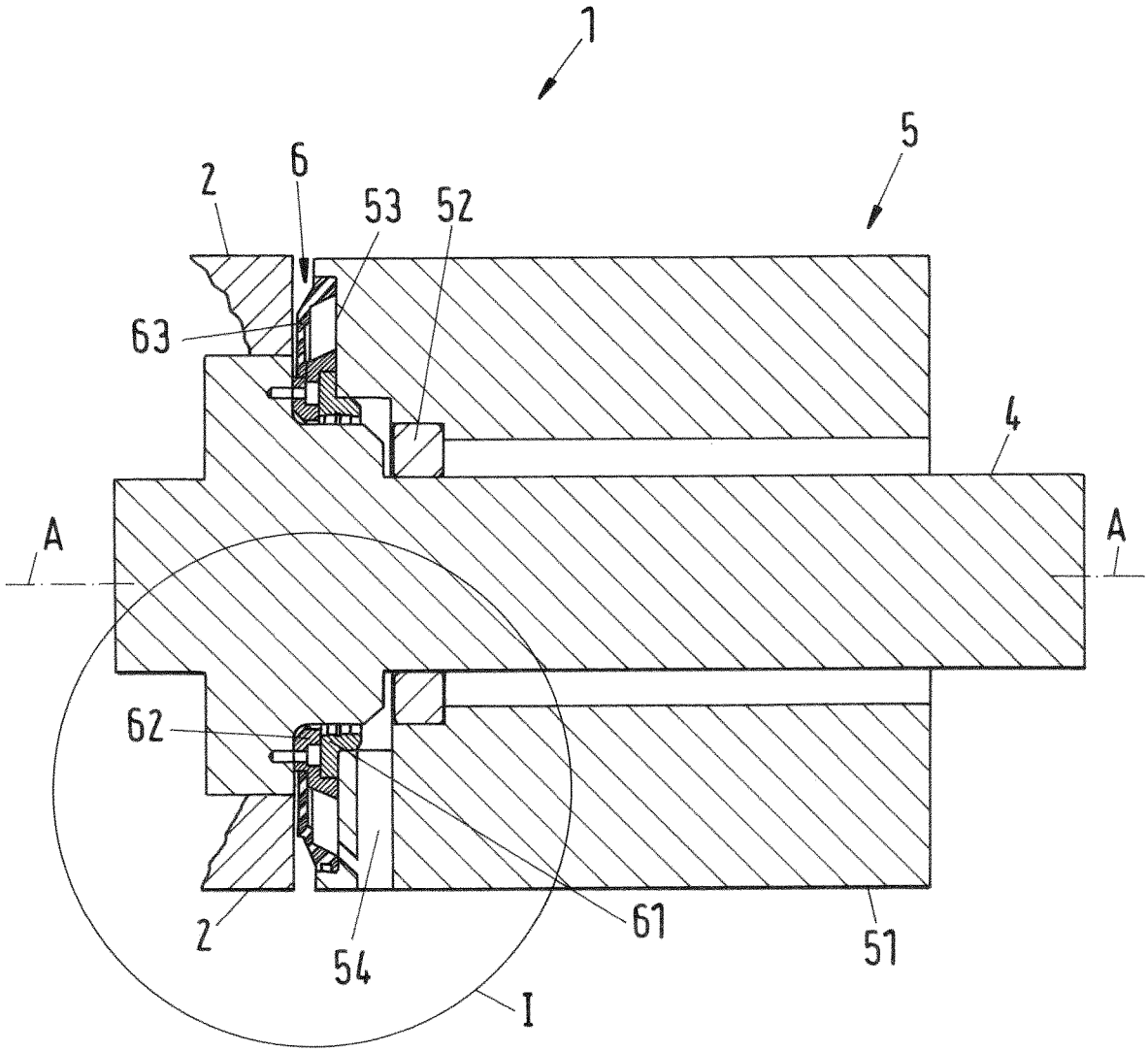
FIG. 2 is a schematic illustration of the embodiment in a cross-sectional view.
Figure 3:
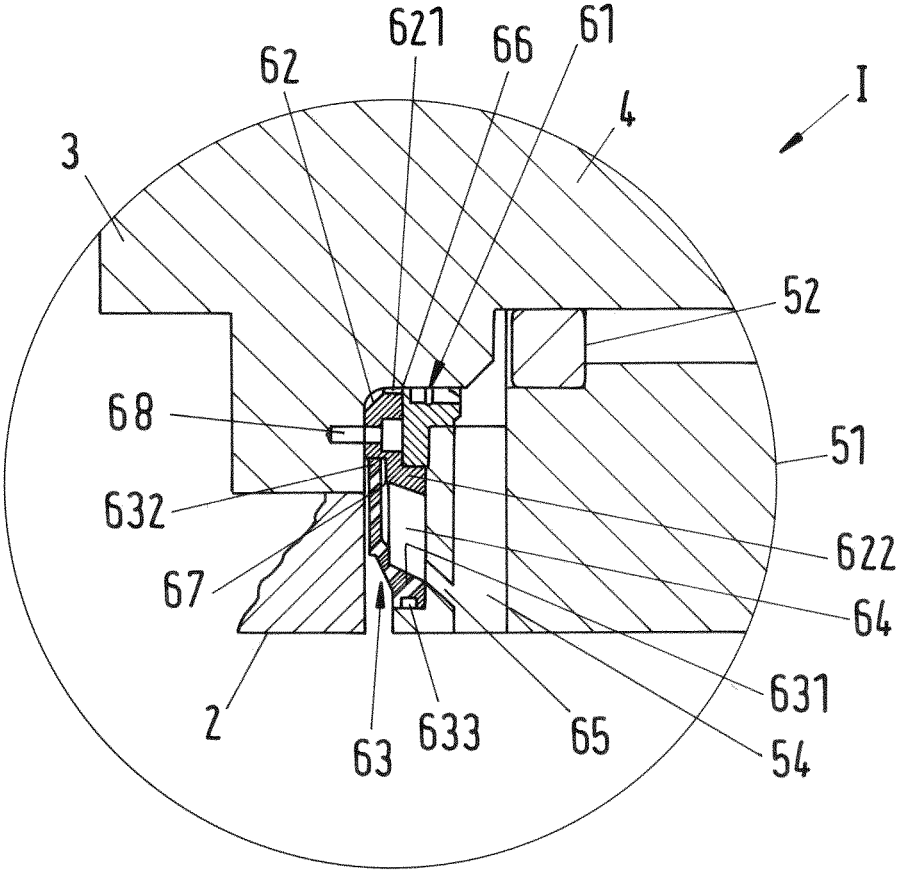
FIG. 3 is a detail of FIG. 2 in an enlarged view.
Figure 4:
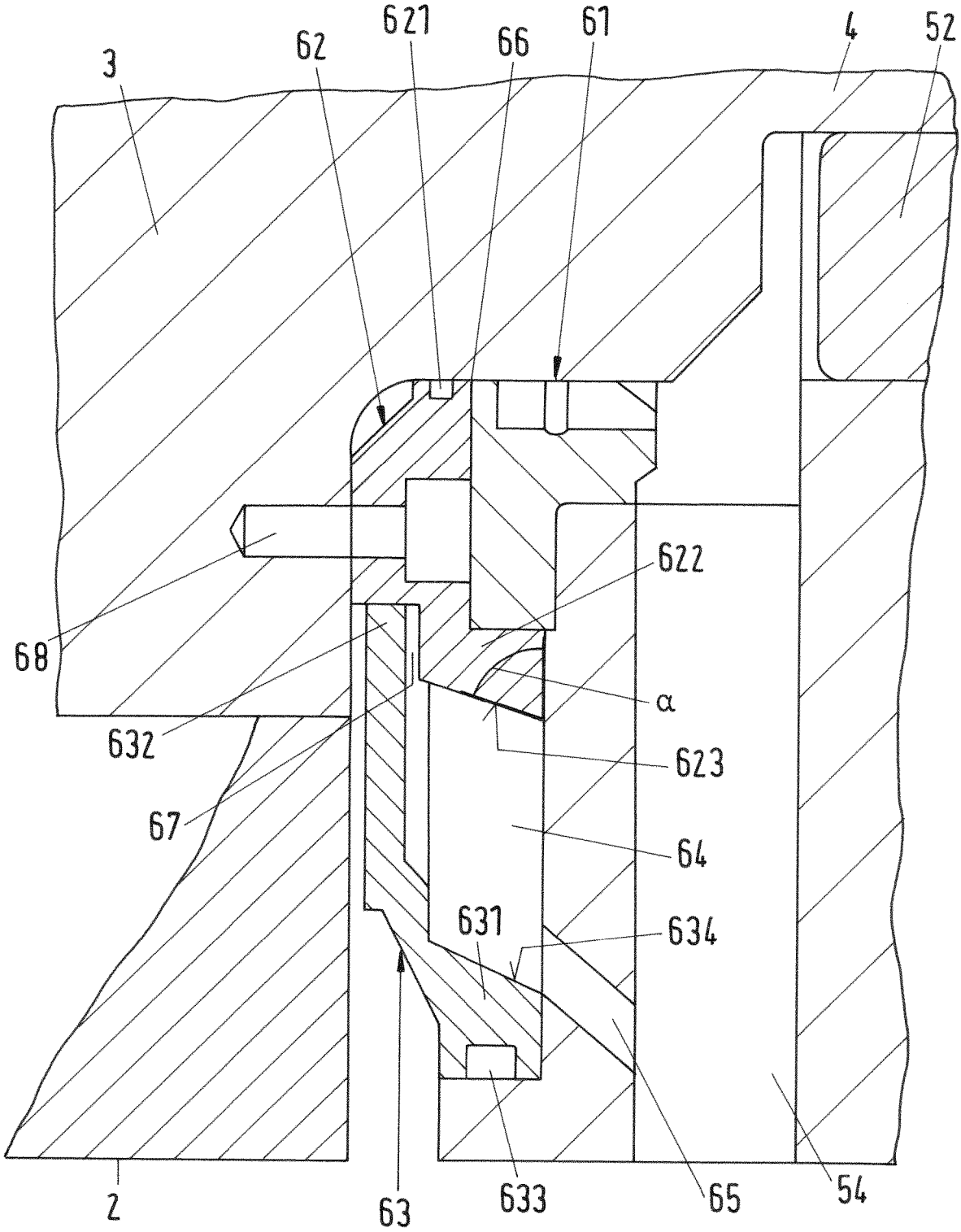
FIG. 4 is similar to FIG. 3, but in an even more enlarged view.

FIG. 1 shows a perspective view illustrating an embodiment of a rotary machine according to the invention which is designated in its entity with reference numeral 1. FIG. 2 shows a more schematic illustration of this embodiment and FIG. 3 an enlarged view of detail I of FIG. 2. FIG. 4 is a representation similar to FIG. 4 but in an even more enlarged view. The representation of such parts and components of the rotary machine 1 that are not essential for the understanding of the invention is omitted in FIG. 1-FIG. 4.

By way of example the embodiment of the rotary machine 1 is designed as a compressor or a blower for delivering air to a process. The compressor 1 sucks air in, for example from the environment, compresses the air and blows the air out to supply it to a process. According to one important application the rotary machine 1 being designed as a compressor or a blower is used in an aeration system for providing a fluid in particular water, with air. For example, in the water industry and in particular for the treatment of wastewater or sewage such compressors 1 are used to enrich or to mix the water with air.

It goes without saying that the invention is neither restricted to this specific example nor to compressors or blowers but is related to rotary machines in general. By way of example the rotary machine 1 may also be a pump, an expander or a turbine.

Referring to FIG. 1-FIG. 4 the embodiment of the rotary machine is now explained in more detail.

The rotary machine 1 for acting on a fluid comprises a stationary housing 2, a rotor 3, that may include an impeller having vanes (not shown), for interacting with the fluid, e.g. air, and a shaft 4 for rotating the rotor 3 about an axial direction A that is defined by the longitudinal axis of the shaft 4. The rotor 3 is arranged in the housing 2.

A direction perpendicular to the axial direction A is referred to as 'radial direction'. The term 'axial' or 'axially' is used with the common meaning 'in axial direction' or 'with respect to the axial direction'. In an analogous manner the term 'radial' or 'radially' is used with the common meaning 'in radial direction' or 'with respect to the radial direction'.

The shaft 4 may be designed as an integral part of the rotor 3 as it is shown for example in FIG. 1. Alternatively, it is also possible to configure the shaft 4 as a separate part that is operatively connected to the rotor 3 in any suited manner to transmit a torque from the shaft 4 to the rotor 3. The shaft 4 is driven by a drive unit (not shown), for example by an electric motor.

The rotary machine 1 further comprises a bearing unit 5 (FIG. 2) for supporting the shaft 4 and therewith the rotor 3 both with respect to the axial direction A and the radial direction. For a better understanding the bearing unit 5 is not shown in FIG. 1. The bearing unit 5 comprises a casing 51 and at least one bearing 52 supporting the shaft 4 in a manner that is as such known in the art. The casing 51 has a recess 53 disposed in one of its axial end faces for receiving a sealing arrangement 6. During operation a lubricant, for example an oil or another suited fluid, is supplied to the bearing unit 5 and in particular to the bearing 52 for lubricating the bearing 52. The lubricant is supplied to the bearing unit 5 through an inlet line (not shown) extending through the casing 51. The bearing unit 5 further comprises a drain channel 54 for discharging the lubricant or excess lubricant from the bearing unit 5. The lubricant passing the drain channel 54 is recycled to a reservoir (not shown).

The casing 51 of the bearing unit is fixed to the housing 2 for example by screws or bolts (not shown).

The sealing arrangement 6 received in the recess 53 has the function to seal the bearing unit 5 and to avoid at the best that the lubricant escapes from the bearing unit 5 by leaking along the shaft 4. The sealing arrangement 6 is designed as a dynamic sealing arrangement 6, meaning that it is adapted for the sealing between a rotating part, namely the shaft 4, and a stationary component. The sealing arrangement 6 comprises a stationary sealing element 61 (not shown in FIG. 1) enclosing the shaft 4. The sealing element 61 is designed as a contactless sealing element 61, meaning that the sealing element has no direct physical contact with shaft 4 during normal operation.

Preferably, the contactless sealing element 61 is designed as a labyrinth seal. Since labyrinth seals or other contactless sealing types are sufficiently known in the art in many different embodiments there is no need for additional explanations.

According to the invention the sealing arrangement 6 further comprises a rotor ring 62 for preventing an axial flow along the shaft 4 to the rotor 3, a cover plate 63 that is fixed with respect to the housing 2 and surrounds the rotor ring 62, as well as a drain chamber 64 which is formed between the rotor ring 62 and the cover plate 63 and a discharge passage 65 for discharging the drain chamber 64. The rotor ring 62 is rotationally fixedly connected to the rotor 3 and arranged axially adjacent to the sealing element 61.

In the preferred embodiment shown in FIG. 1-FIG. 4 the rotor ring 62 is fixed to the rotor 3 by a plurality of screws 68. The rotor ring 62 has an inner diameter, which is configured such that the rotor ring 62 closely fits around the shaft 4 and is preferably in contact with the shaft 4. Typically, the inner diameter of the rotor ring 62 is somewhat smaller than the inner diameter of the stationary sealing element 61 because the contactless sealing element 61 requires a clearance between the shaft 4 and the sealing element 61. Because the rotor ring 62 is co-rotating with the shaft 4, it does not require a clearance with respect to the shaft 4 but may be configured for a sealing engagement with the shaft 4. Therefore, any flow of lubricant escaping through the sealing element 61 along the shaft 4 in axial direction A is stopped at the rotor ring 62 and cannot proceed into the rotor 3. With respect to the axial direction A the rotor ring 62 constitutes a barrier to the lubricant tracking across the shaft 4. Lubricant arriving at the rotor ring 62 is forced to move outwards. This outwards movement is supported by centrifugal forces acting on the lubricant.

In order to improve the sealing action of the rotor ring 62 with respect to the axial direction A the rotor ring 62 has a radially inner edge that is provided with a circumferential groove 621 that receives an O-ring sealing which is pressed against the shaft 4.

Regarding the axial direction A the rotor ring 62 is arranged in close proximity to the stationary sealing element 61. There is only a narrow first gap 66 between the rotor ring 62 and the stationary sealing element 61, i.e. the first gap 66 is configured as a running fit that provides the necessary clearance for enabling a contactless rotation of the rotor ring 62 with respect to the stationary sealing element 61. A typical value for the extension of the first gap 66 in the axial direction is less than 2 mm, preferably less than 1 mm and for example approximately 0.5 mm.

The advantage of the narrow first gap 66 is the reduction of undesired impacts of pressure differentials that occur during operation. When the rotor 3 is for example compressing air during operation this results in a low pressure on the side of the rotor 3 facing the sealing arrangement 6. Thereby a pressure differential exists with the lower pressure at the rotor 3 side and the higher pressure at the bearing unit 5 side. This pressure difference tends to suck the lubricant from the bearing unit 5 through the sealing arrangement 6 towards the rotor 3 which is a known problem in state of the art solutions. The close running fit, i.e. the narrow first gap 66 between the rotor ring 62 and the stationary sealing element 61 at least considerably reduces this undesired sucking effect caused by the pressure differential.

The rotor ring 62 further comprises a radially outer edge 622 extending in the axial direction A and away from the rotor 3. The radially outer edge 622 of the rotor ring 62 surrounds the static sealing element 61. Preferably the gap between the outer edge 622 and the static sealing element 61, which extends in the axial direction A, is also configured as a running fit in an analogous manner as the first gap 66. This measure further reduces the negative effects caused by the pressure differential during operation.

The stationary cover plate 63 is ring-shaped and fixed with respect to the housing 2. The outer diameter of the cover plate 63 is larger than the diameter of the end face of the rotor 3 that faces the sealing arrangement 6. Thus, the outer rim 631 of the cover plate 63 protrudes over the axial end face of the rotor 3 with respect to the radial direction and protects the rotor 3 against penetration of the lubricant, in particular such lubricant that has been moved away from the region of the shaft by means of the rotor ring 62.

The ring-shaped cover plate 63 has an inner edge region 632 that overlaps the rotor ring 62 with respect to the radial direction. To this end the inner diameter of the cover plate 63 is smaller than the outer diameter of the rotor ring 62. The overlap between the rotor ring 62 and the cover plate 63 contributes to closing all possible leakage paths along which the lubricant could proceed to the rotor 3 as well as to the reduction of the impact of the pressure differential already described.

The inner edge region 632 of the cover plate 63 is separated from the rotor ring 62 by a second gap 67 extending in the radial direction. By the same reasons and in an analogous manner as explained with respect to the first gap 66 the second gap 67 is also configured as a running fit, i.e. the second gap 67 is designed as narrow with respect to the axial direction A that it just provides the necessary clearance for a contactless rotation of the rotor ring 62 with respect to the cover plate 63.

The outer rim 631 of the cover plate 63 extends in the axial direction A away from the rotor 3. By this measure the outer edge 622 of the rotor ring 62 and the outer rim 631 of the cover plate 63 delimit the drain chamber 64 in which the lubricant is collected that is moved outwards by means of the rotor ring 62. The outer edge 622 of the rotor ring 62 and the outer rim 631 of the cover plate 63 delimit the drain chamber with respect to the radial direction, i.e. the outer edge 622 of the rotor ring 62—more precisely the radially outer surface 623 of the outer edge 622—forms the radially inner wall of the drain chamber 54 and the outer rim 631 of the cover plate 63—more precisely the radially inner surface 634 of the outer rim 631—forms the radially outer wall of the drain chamber 54. Preferably, both the radially outer surface 623 of the outer edge 622 and the radially inner surface 634 of the outer rim 631 are obliquely extending with respect to the axial direction A. In particular, both the outer rim 631 of the cover plate 63 and the outer edge 622 of the rotor ring 62 are designed to taper towards the rotor 3, so that any lubricant collecting on the radially outer surface 623 or the radially inner surface 634, respectively, is moved in a direction away from the rotor 3 my means of the gravity. The radially outer surface 623 and the radially inner surface 634 may—but do not necessarily have to—extend parallel to each other, i.e. the inclination of the radially outer surface 623 with respect to the axial direction A may be the same as the inclination of the radially inner surface 634 with respect to the axial direction.

In particular, the inclination of the radially outer surface 623 of the outer edge 622 of the rotor ring advantageously leads the lubricant away from the rotor 3. As can be best seen in FIG. 4, the radially outer surface 623 of the outer edge 622 of the rotor ring 62 is configured to include an inclination angle a with the radial direction, with the inclination angle a being smaller than goo and larger than 0°. Hence, the radially outer surface 623 is slanted with respect to the axial direction A at an angle of goo minus the inclination angle a.

Preferably the inclination angle a is at most 85°. For example, the inclination angle a may be between 70° and 75° or even smaller.

As already discussed the sealing arrangement 6 is arranged in the recess 53 of the casing 51 of the bearing unit. The diameter of the annular recess 53 essentially corresponds to the outer diameter of the cover plate 63 to enable a close fit of the cover plate 63 in the recess 53. That is, the diameter of the annular recess 53 only exceeds the outer diameter of the cover plate 63 to such an amount that is necessary to place the cover plate 63 in the recess 53. This measure prevents that the lubricant leaks in particular from the drain chamber 64 to the environment.

In order to improve the sealing action between the cover plate 63 and the surface delimiting the recess 53 the cover plate 63 comprises a ring-shaped sealing member, preferably an O-ring sealing, for sealing between the recess 53 and the cover plate 63. The sealing member is arranged in a circumferential groove 633 in the outer rim 631 of the cover plate 63.

The discharge passage 65 for discharging the drain chamber 64 is designed as a bore in the bearing unit 5, more particular in the casing 51 of the bearing unit. Preferably the discharge passage 65 has an inner diameter of at most 20 mm, preferably of at most 10 mm. The inner diameter is for example 8.5 mm. The discharge passage 65 is connected to the drain channel 54 of the bearing unit 5. Thus, the lubricant is discharged from the drain chamber 54 through the discharge passage 65 and recycled to the drain channel 54.

By the sealing arrangement 6 it is reliably avoided that the lubricant escaping through the static sealing element 61 along the shaft 4 enters the rotor 3 or leaks to the environment.

The invention claimed is:

1. A rotary machine for acting on a fluid, the rotary machine comprising:

a stationary housing;

a rotor configured to interact with the fluid;

a shaft configured to rotate the rotor about an axial direction;

a bearing configured to support the rotor; and a sealing arrangement configured to seal the bearing with respect to the rotor, the rotor being arranged in the housing, and the sealing arrangement comprising a stationary sealing element surrounding the shaft and configured to contactless seal the shaft, the sealing arrangement further comprising a rotor ring configured to prevent an axial flow along the shaft to the rotor and a cover plate, the rotor ring rotationally fixedly connected to the rotor and arranged axially adjacent to the sealing element, the rotor ring comprising a radially outer edge extending in the axial direction and surrounding the sealing element, the cover plate fixed with respect to the housing and surrounding the rotor ring, the cover plate having an outer rim extending in the axial direction, a drain chamber formed between the outer edge of the rotor ring and the outer rim of the cover plate, and a discharge passage provided to discharge the drain chamber.

2. The rotary machine in accordance with claim 1 wherein the rotor ring has a radially inner edge with a circumferential groove configured to receive an annular seal that encloses the shaft.

3. The rotary machine in accordance with claim 1, wherein the rotor ring is separated from the sealing element in the axial direction by a first gap that is a running fit.

4. The rotary machine in accordance with claim 3, wherein the inner edge region of the cover plate is separated from the rotor ring by a second gap that is a running fit.

5. The rotary machine in accordance with claim 1, wherein the cover plate is a ring-shaped cover plate having an inner edge region that overlaps the rotor ring with respect to the radial direction.

6. The rotary machine in accordance with claim 1, wherein the radially outer edge of the rotor ring tapers towards the rotor.

7. The rotary machine in accordance with claim 1, wherein a radially outer surface of the outer edge of the rotor ring includes an inclination angle with the radial direction, the inclination angle being smaller than 90°.

8. The rotary machine in accordance with claim 1, wherein the cover plate and the rotor ring are arranged in an annular recess in the bearing unit.

9. The rotary machine in accordance with claim 8, wherein the cover plate comprises a ring-shaped sealing member configured to seal between the recess and the cover plate, the sealing member being arranged in a circumferential groove in the outer rim of the cover plate.

10. The rotary machine in accordance with claim 1, wherein the discharge passage is a bore in the bearing unit.

11. The rotary machine in accordance with claim 1, wherein the discharge passage has an inner diameter of at most 20 mm.

12. The rotary machine in accordance with claim 1, wherein the discharge passage is connected to a drain channel of the bearing unit.

13. The rotary machine in accordance with claim 1, wherein the sealing element of the sealing arrangement is a labyrinth seal.

14. The rotary machine in accordance with claim 1, wherein the rotary machine is a blower, a compressor, a pump, an expander or a turbine.

15. The rotary machine in accordance with claim 1, wherein the rotary machine is a blower or a compressor in an aeration system configured to provide a fluid with air.

16. The rotary machine in accordance with claim 1 wherein the rotor ring has a radially inner edge with a circumferential groove configured to receive an O-ring seal, that encloses the shaft.

17. The rotary machine in accordance with claim 1, wherein a radially outer surface of the outer edge of the rotor ring includes an inclination angle with the radial direction, the inclination angle being at most 85°.

18. The rotary machine in accordance with claim 8, wherein the cover plate comprises an O-ring configured to seal between the recess and the cover plate, the O-ring being arranged in a circumferential groove in the outer rim of the cover plate.

19. The rotary machine in accordance with claim 1, wherein the discharge passage has an inner diameter of at most 10 mm.

20. The rotary machine in accordance with claim 1, wherein the rotary machine is a blower or a compressor in an aeration system configured to provide water with air.

* * * * *